US008523326B2

(12) United States Patent
Enomoto et al.

(10) Patent No.: US 8,523,326 B2
(45) Date of Patent: Sep. 3, 2013

(54) LIQUID EJECTING HEAD AND LIQUID EJECTING APPARATUS

(71) Applicant: Seiko Epson Corporation, Tokyo (JP)

(72) Inventors: Katsumi Enomoto, Nagano-ken (JP); Shunsuke Watanabe, Nagano-ken (JP); Yuma Fukuzawa, Nagano-ken (JP); Satoshi Oguchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/664,660

(22) Filed: Oct. 31, 2012

(65) Prior Publication Data

US 2013/0120501 A1 May 16, 2013

(30) Foreign Application Priority Data

Nov. 10, 2011 (JP) ..... 2011-246065

(51) Int. Cl.
*B41J 2/14* (2006.01)
*B41J 2/16* (2006.01)

(52) U.S. Cl.
USPC ..... 347/50; 347/65

(58) Field of Classification Search
USPC ..... 347/20, 40–44, 49–50, 58, 64, 65, 347/84–86
See application file for complete search history.

(56) References Cited

U.S. PATENT DOCUMENTS 6,905,342 B2 * 6/2005 Swier et al. ..... 439/65
8,371,697 B2 * 2/2013 Kemp et al. ..... 353/31

FOREIGN PATENT DOCUMENTS

JP 2010-023437 2/2010

* cited by examiner

*Primary Examiner* — Thinh Nguyen

(57) ABSTRACT

A head unit fixed to a case in a position in which a nozzle forming surface thereof faces a first surface side of a head fixing portion, and a wiring substrate is arranged on a second surface side opposite from the first surface on a portion. A supply flow channel in the case communicate with a common liquid chamber at an end portion of the communicating flow channel in a first direction, and a flexible cable is disposed inside the supply flow channel in the case in the first direction.

6 Claims, 7 Drawing Sheets

LIQUID EJECTING HEAD AND LIQUID EJECTING APPARATUS

This application claims a priority to Japanese Patent Application No. 2011-246065 filed on Nov. 10, 2011 which is hereby expressly incorporated by reference herein in its entirety.

BACKGROUND

1. Technical Field

The present invention relates to a liquid ejecting head such as an ink jet recording head and a liquid ejecting apparatus and, more specifically, to a liquid ejecting head including a holding member provided with a head unit configured to eject liquid from a nozzle, a wiring member configured to be electrically connected to pressure generating units, and a wiring substrate configured to supply drive signals to the pressure generating units through the wiring member, and a liquid ejecting apparatus.

2. Related Art

A liquid ejecting apparatus is an apparatus including a liquid ejecting head, and configured to eject various types of liquid from the liquid ejecting head. Examples of a liquid ejecting apparatus include image recording apparatuses such as ink jet printers and ink jet plotters. However, in recent years, liquid ejecting apparatuses have also been applied to various types of manufacturing apparatuses by taking advantage of property that an extremely small amount of liquid is dropped accurately on a predetermined position. For example, the invention can be applied to display manufacturing apparatuses configured to manufacture color filters such as liquid crystal displays, electrode forming apparatuses configured to form electrodes such as those of organic electro luminescence displays, FEDs (surface emitting displays), and chip manufacturing apparatuses configured to manufacture biochips (biochemical elements). A recording head for image recording apparatuses ejects liquid ink, and a color material ejecting head for display manufacturing apparatuses ejects liquid solutions of respective color materials of R (Red), G (Green), and B (Blue). An electrode material ejecting head for an electrode forming apparatuses ejects a liquid electrode material and a bioorganic substance ejecting head for a chip manufacturing apparatuses ejects a liquid solution of bioorganic substance.

There are various types of liquid ejecting heads as described above, and those employing a so-called on-demand system which is in widespread use include a series of liquid flow channels, provided in a plurality, extending from a common liquid chamber (also referred to as a reservoir or a manifold) via pressure chambers to nozzles so as to correspond to nozzles, and are configured, for example, to eject liquid droplets from the nozzles by using pressure variations generated in the liquid in the pressure chambers by driving pressure generating units such as piezoelectric elements or heat generating elements.

A supply flow channel to which liquid from a liquid supply source such as an ink cartridge is supplied communicates with the common liquid chamber. The supply flow channel is located at a center portion of the common liquid chamber in the longitudinal direction, and is configured in such a manner that the distance from a communicating point (introduction port) between the supply flow channel and the common liquid chamber to the pressure chamber located at the farthest position from the introduction port from among the respective pressure chambers communicating with the common liquid chamber is as small as possible (that is, the distance is approximately half the dimension of the common liquid chamber in the longitudinal direction) (for example, see JP-A-2010-023437 (FIG. 2, and so forth). Accordingly, pressures of ink supplied to the respective pressure chamber communicating the same common liquid chamber are prevented from becoming unbalanced.

Incidentally, examples of a liquid ejecting head of this type include a liquid ejecting head provided on a case member (holding member), the liquid ejecting head including a wiring substrate (printed board) configured to receive a drive signal from an apparatus body side and supply the received drive signal to the pressure generating units, and the drive signal is supplied from the wiring substrate to the respective pressure generating units through a wiring member having flexibility (hereinafter, referred to as a flexible cable) such as a COP (chip on film) or TCP (tape carrier package). The flexible cable has a configuration in which a conductive pattern is formed on a surface of, for example, a base film such as polyimide using copper foil or the like, and the conductive pattern is covered with resist. A terminal portion on one end of the flexible cable is connected to a terminal portion of the pressure generating unit, and a terminal portion on the other end is connected to a base terminal portion on the wiring substrate.

The flexible cable is wired in a limited space in a recording head (in the case member). In particular, in the configuration in which the supply flow channel is connected to the center portion of the common liquid chamber, wiring of the flexible cable that bypasses the supply flow channel or provision of a clearance hole configured to allow passage of the supply flow channel of the flexible cable is needed. In the former case, in a configuration in which the length of the flexible cable is fixed to a certain length because of a layout or the like of the conductive pattern, it is necessary to wire the flexible cable along the direction of the height of the case member in order to avoid interference with respect to the supply flow channel, and hence the case member is required to have a height that correspondingly depends on the length of the flexible cable. Therefore, there is a problem of an increase in the size of the recording head. In the latter case, when the clearance hole as described above is formed in the flexible cable, formation of a conductive pattern on the flexible cable that bypasses the clearance hole is necessary. Therefore, there is a problem of an increase in the size of the flexible cable and an increase in cost. In the same manner, in the latter configuration, formation of the clearance hole configured to allow passage of the supply flow channel in the wiring substrate is needed, and hence the cost is increased in association with increase in the size of the wiring substrate in this aspect as well.

SUMMARY

An advantage of some aspects of the invention is that there is provided a liquid ejecting head configured to be capable of having a reduced size of the head and a reduced cost, and a liquid ejecting apparatus having the same.

In order to achieve the above described object, there is provided a liquid ejecting head comprising:

a holding member (case 15), the holding member including: a head unit (16) including a nozzle forming surface (nozzle plate 23) formed with nozzles (28) arranged horizontally in a first direction; a pressure generating unit (piezoelectric elements 36) configured to cause pressure variations in a pressure chamber (32) communicating the nozzles; and a common liquid chamber (33) formed along the first direction and to which liquid common to a plurality of the pressure chambers is introduced, and configured to eject the liquid from the nozzles by driving the pressure generating unit; a wiring member (flexible cables 40) electrically connected at an end portion thereof to the pressure generating unit; a wiring substrate (30) electrically connected to the other end portion of the wiring member and configured to supply a drive signal to the pressure generating unit via the wiring member; a supply flow channel (14) configured to supply the liquid from a liquid supply source to the common liquid chamber, wherein the head unit is fixed to the holding member in a position in which the nozzle forming surface faces a first surface and the wiring substrate is arranged on a second surface side on the opposite side from the first surface of the head fixing portion, the supply flow channel communicates with the common liquid chamber at an end of the common liquid chamber in the first direction, and the wiring member is disposed inside the supply flow channel in the first direction in the interior of the holding member.

According to the invention, since the supply flow channels communicate with the common liquid chambers at the end portions of the common liquid chambers in the first direction, and the wiring member is disposed inside the supply flow channel in the first direction in the interior of the holding member, the wiring member may be wired by being bent as needed without causing the interference with the supply flow channel between the pressure generating unit and the wiring substrate or without providing clearance holes or the like to allow passage of the supply flow channel in the wiring member. Therefore, even when the entire length of the wiring member is determined to be constant, a wiring space in the height direction of the holding member can be reduced by wiring the wiring member in a bent state or by wiring obliquely with respect to the nozzle forming surface, which contributes to downsizing of the liquid ejecting head. Since the clearance hole or the like which allows passage of the supply flow channels does not have to be provided in the wiring member, the size of the wiring member may be reduced correspondingly, which contributes to downsizing of the liquid ejecting head.

Preferably, an opening portion on an inlet port side of the supply flow channel is formed on the outside of the wiring substrate in the first direction in the second surface side.

In this configuration, since the clearance hole which allows passage of the supply flow channels in the wiring substrate does not have to be provided, the size of the wiring substrate may be reduced correspondingly, which contributes to downsizing of the liquid ejecting head.

Furthermore, in the configuration as described above, preferably, the wiring substrate includes a substrate terminal portion on the first surface side in a state of being arranged on the second surface, and the substrate terminal portion and the other end terminal portion of the wiring member are electrically connected.

In this configuration, since the wiring substrate has a configuration in which the substrate terminal portion is provided on the first surface side in the state in which the wiring substrate is arranged on the on the second surface and the substrate terminal portions and the other end terminal portions of the wiring member are electrically connected, though holes for allowing insertion of the wiring member do not have to be provided in the wiring substrate, so that the size of the wiring substrate may be reduced correspondingly. Accordingly, contribution to further downsizing of the liquid ejecting head is made.

The liquid ejecting apparatus includes the liquid ejecting head according to any one of the liquid ejecting head configured as described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Referring now to attached drawings, embodiments of the invention will be described below. In the embodiments described below, various definitions are made as preferred embodiments of the invention. However, the scope of the invention is not limited to these modes unless otherwise specified in description given below to the effect of defining the invention. In the description given below, an ink jet printer (a type of liquid ejecting apparatus of the invention) including an ink jet recording head as a type of liquid ejecting head (hereinafter, referred to as a recording head) will be exemplified as the liquid ejecting apparatus of the invention.

Figure 1:
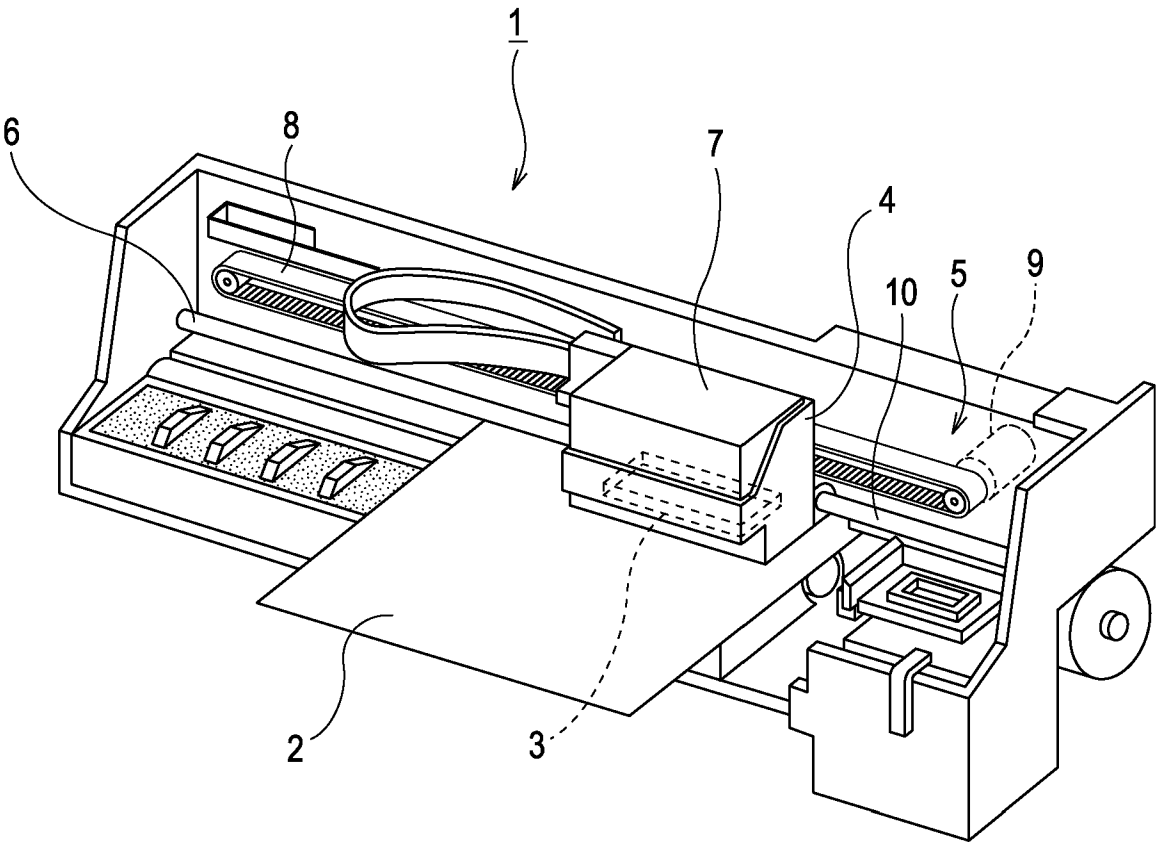
FIG. 1 illustrates a perspective view for explaining a configuration of a printer.

Referring now to FIG. 1, a configuration of a printer 1 will be described. The printer 1 is an apparatus configured to perform recording of an image or the like by ejecting liquid ink to a surface of a recording medium 2 (a type of an object to be ejected) such as a recording sheet or the like. The printer 1 includes a recording head 3 configured to eject ink, a carriage 4 on which the recording head 3 is mounted, a carriage movement mechanism 5 configured to move the carriage 4 in a primary scanning direction, and a platen roller 6 configured to transport the recording medium 2 in a secondary scanning direction. The ink described above is a type of liquid of the invention, and is stored in an ink cartridge 7 as a liquid supply source. The ink cartridge 7 is demountably mounted on the recording head 3. A configuration in which the ink cartridge 7 is arranged on the side of a main body of the printer 1 and ink is supplied from the ink cartridge 7 through an ink supply tube to the recording head 3 may also be employed.

The carriage movement mechanism 5 described above is provided with a timing belt 8. Then, the timing belt 8 is driven by a pulse motor 9 such as a DC motor. Therefore, when the pulse motor 9 is activated, the carriage 4 is reciprocated in the primary scanning direction (the widthwise direction of the recording medium 2) while being guided by a guide rod 10 spanning across the printer 1.

Figure 2:
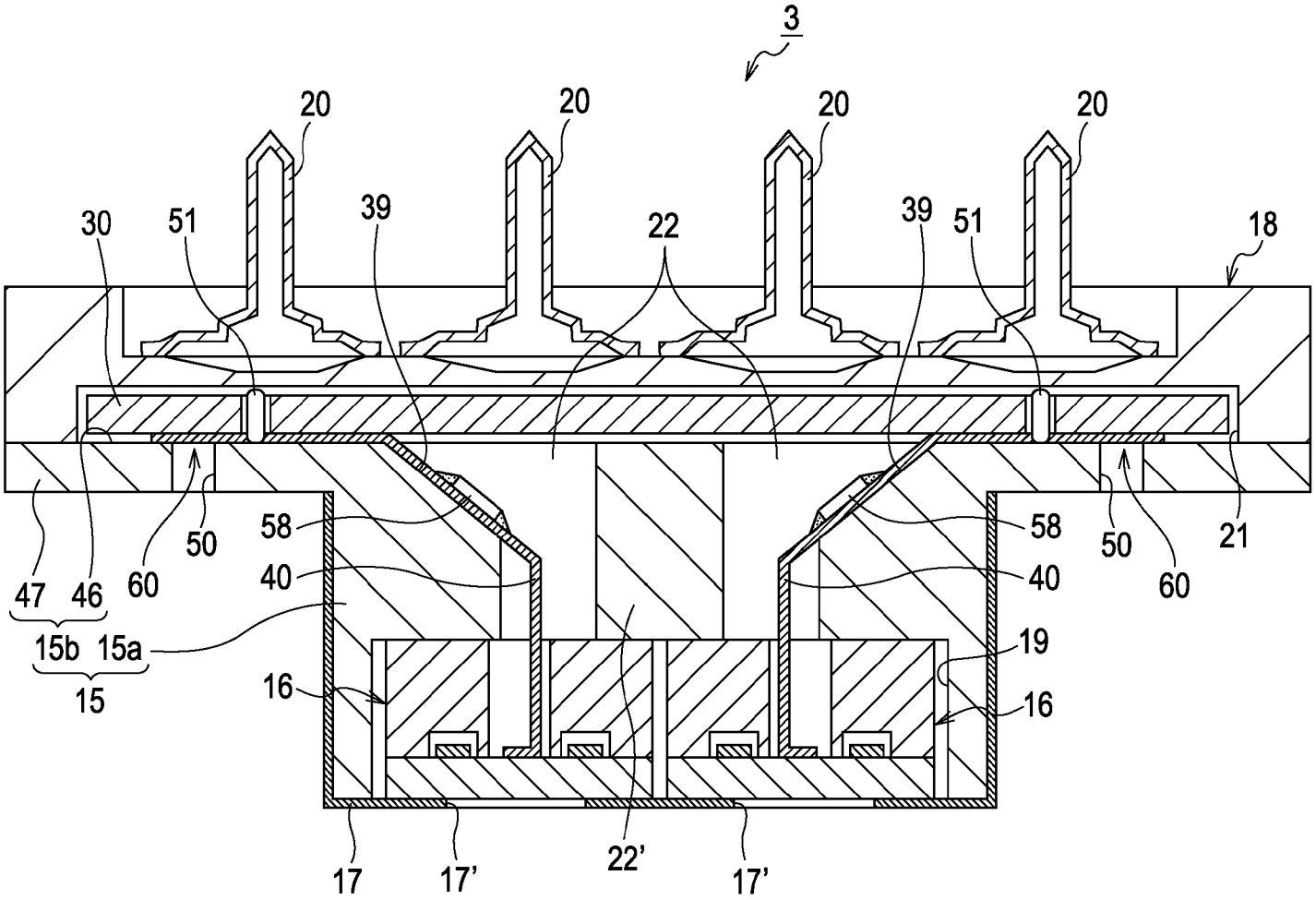
FIG. 2 illustrates a cross-sectional view of a recording head in the direction orthogonal to a nozzle row (second direction).
Figure 3:
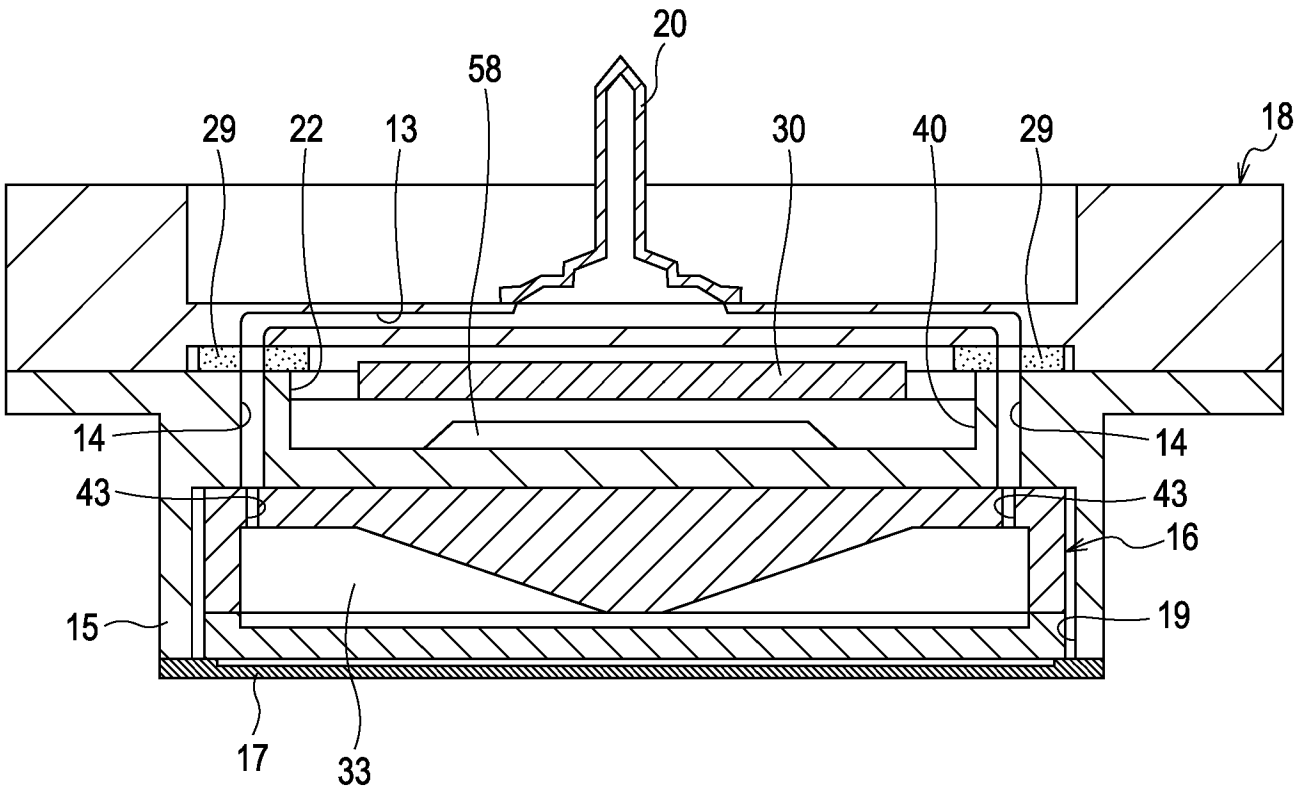
FIG. 3 illustrates a cross-sectional view of the recording head in the direction of the nozzle row (first direction).
Figure 4:
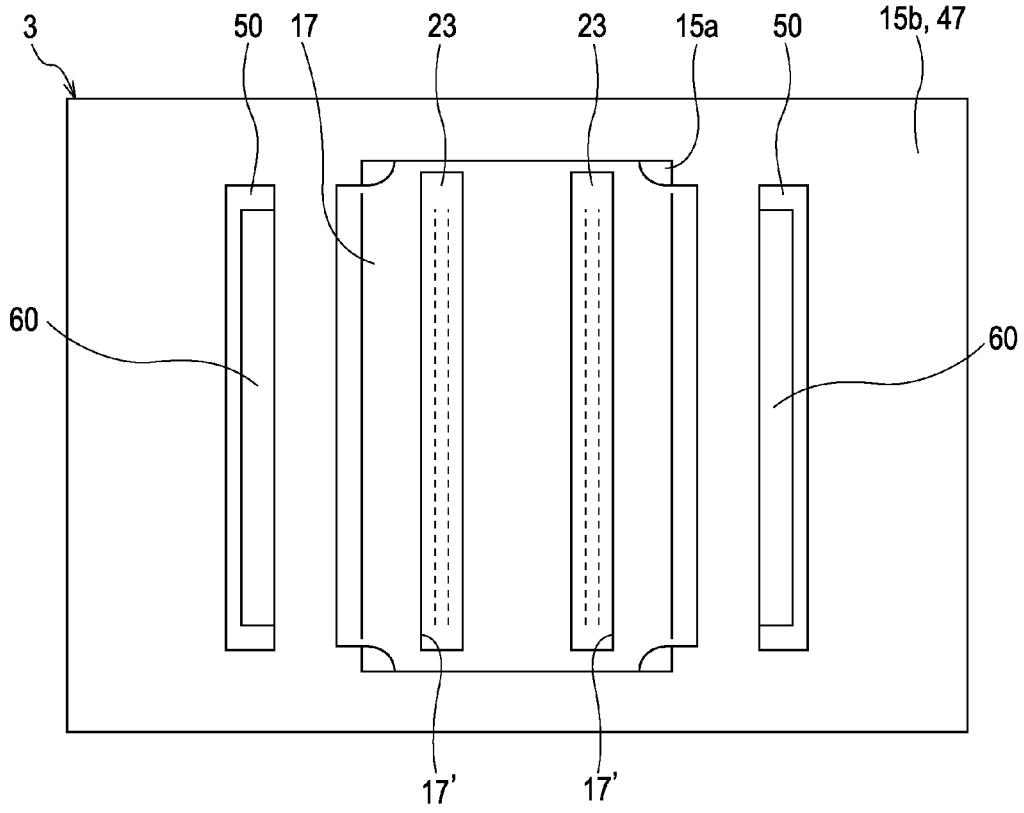
FIG. 4 illustrates a bottom view of the recording head.
Figure 5:
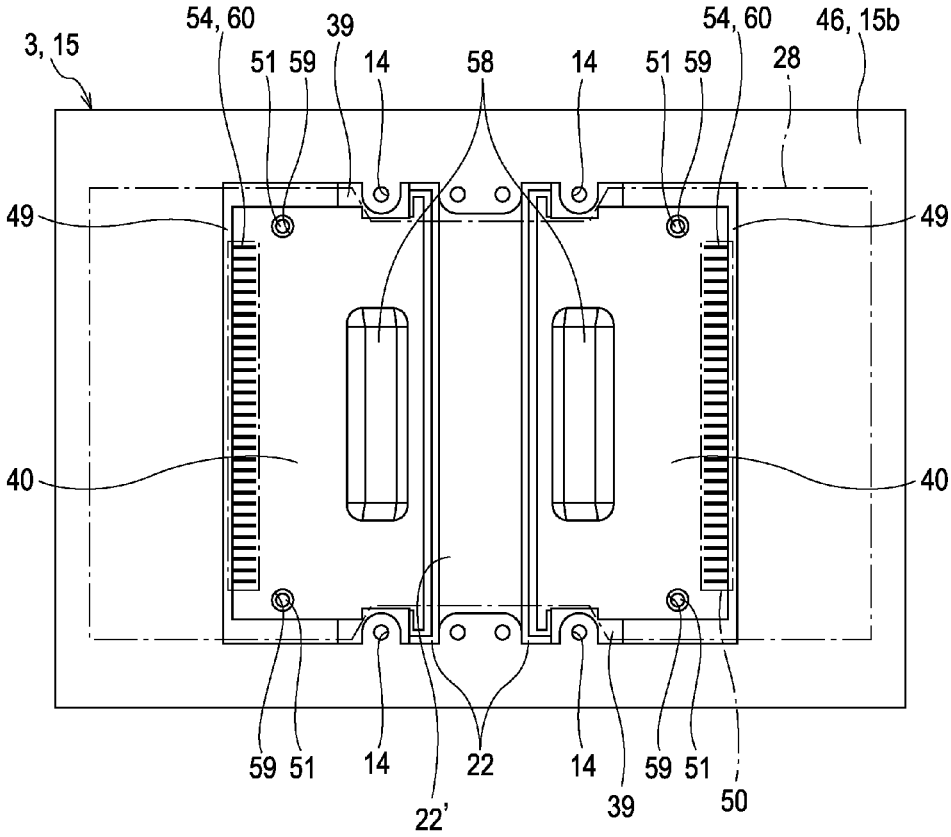
FIG. 5 illustrates a top view of the recording head.

FIG. 2 illustrates a cross-sectional view of the recording head 3 in a direction orthogonal to nozzle rows (a second direction) and FIG. 3 illustrates a cross-sectional view of the recording head 3 in the direction of the nozzle rows (a first direction). FIG. 4 illustrates a bottom view of the recording head 3 and FIG. 5 illustrates a top view of the recording head 3 (a state in which a needle holder 18 is not mounted). The recording head 3 of the embodiment includes a case 15 (corresponding to a holding member in the invention), a head unit 16, a unit fixing plate 17, and the needle holder 18.

The needle holder 18 is a member provided with a plurality of ink introduction needles 20, that extend upright from an upper surface side thereof, and is formed of, for example, synthetic resin. In the embodiment, a total of four of the ink introduction needles 20 are disposed horizontally on the upper surface of the needle holder 18 in a one to one correspondence with ink in each of the ink cartridges 7 for the respective colors. The ink introduction needles 20 are hollow needle shaped members to be inserted into the ink cartridges 7, and introduce ink stored in the ink cartridges 7 from introduction holes (not illustrated) formed at distal ends thereof to the head unit 16 side through supply flow channels 14 in the case 15. As illustrated in FIG. 3, the needle holder 18 is formed in the interior thereof with flat flow channels 13 each communicating with internal flow channels of the ink introduction needles 20. The flat flow channels 13 each branch to the left and right in the first direction, which is the direction of the nozzle row below each of the ink introduction needles 20, and extend to both ends in the same direction. Each of the flat flow channels 13 communicates with a corresponding one of the supply flow channels 14 in the case 15 respectively in a liquid tight manner via a packing 29 formed of a resilient material such as rubber or elastomer at both end portions in the direction of the nozzle rows. On a lower surface side of the needle holder 18, a substrate housing 21 (see FIG. 2) is formed in which a wiring substrate 30 arranged on a substrate mounting surface 46 (corresponding to a second surface of the invention), which is an upper surface of the case 15, is housed. The needle holder 18 is fixed to the substrate mounting surface 46 side of the case 15 in a state in which the wiring substrate 30 is housed in the substrate housing 21.

The case 15 is a hollow-box-shaped member formed of, for example, a synthetic resin. The case 15 includes a head fixing portion 15*a* to which the head unit 16 is fixed, and a substrate holding portion 15*b* in which the wiring substrate 30 is held and the needle holder 18 is fixed. In the interior of the head fixing portion 15*a* on a bottom surface (a first surface in the invention) side, a head unit housing space 19 is formed in which the head unit 16 is housed. In the interior of the head unit housing space 19 of the embodiment, a total of two of the head units 16 are housed horizontally in the second direction (the left and right direction in FIG. 2) orthogonal to the direction of the nozzle rows. The respective head units 16 in the head unit housing space 19 are fixed to the metallic unit fixing plate 17 having two openings 17' formed so as to correspond to the respective head units 16.

In the interior of the head fixing portion 15*a* on the substrate holding portion 15*b* side (the substrate mounting surface 46 side), wiring spaces 22 are formed that communicate at lower ends thereof with the head unit housing space 19 and are open at upper ends thereof to the substrate mounting surface 46. In the embodiment, a total of two of the wiring spaces 22 corresponding to the two head units 16 are provided in the head fixing portion 15*a* by being partitioned by a partitioning wall 22'. Part of an inner wall of each of the wiring spaces 22, more specifically, a substantially upper half of the inner wall surface on the outside in the second direction is inclined upward toward the substrate mounting surface 46. These surfaces function as guide surfaces 39 configured to guide flexible cables 40 toward wiring areas 49 on the substrate mounting surface 46 as described later.

The substrate holding portion 15*b* is a member formed integrally with the head fixing portion 15*a* on an upper surface side thereof. An upper surface of the substrate holding portion 15*b* corresponds to the substrate mounting surface 46 on which the wiring substrate 30 and the other end portions of the flexible cables 40 are placed. In plan view, the surface area of the substrate mounting surface 46 is larger than the surface area of the head fixing portion 15*a*. A portion of the substrate holding portion 15*b* projecting sideward with respect to the head fixing portion 15*a* corresponds to a flange portion 47. The wiring spaces 22 of the head fixing portion 15*a* are respectively open at a center portion of the substrate mounting surface 46. As illustrated in FIG. 5, the wiring areas 49 where the other end portions of the flexible cables 40 drawn from the wiring spaces 22 are arranged are respectively partitioned on the outsides of the openings of the respective wiring spaces 22 in the second direction on the substrate mounting surface 46. Positioning pins 51 are provided at both end portions of the wiring areas 49 in the first direction so as to project therefrom. In the embodiment, since the two wiring areas 49 are defined, a total of four of the positioning pins 51 are provided on the substrate mounting surface 46. The positioning pins 51 are configured to set a relative position between the flexible cable 40 and the wiring substrate 30 on the substrate mounting surface 46.

On the substrate mounting surface 46, upstream ends of the supply flow channels 14 are open at both end portions of the openings of the respective wiring spaces 22 (or the wiring areas 49) in the first direction. As illustrated in FIG. 3, the respective supply flow channels 14 are elongated flow channels extending along the direction of the height of the case 15 from the substrate mounting surface 46 side to the head units 16 side in the interior of the case 15. Lower ends of the supply flow channels 14 communicate with common liquid chambers 33 via ink introduction channels 43 of the head units 16. In the embodiment, two of the supply flow channels 14 are provided for each common liquid chamber 33. A pair of the supply flow channels 14 communicating with the same common liquid chamber 33 are formed on both sides with the wiring spaces 22 interposed therebetween in the first direction in the interior of the case 15. Therefore, the respective supply flow channels 14 communicate with the common liquid chambers 33 at ends of the common liquid chambers 33 in the first direction.

As illustrated in FIG. 4, the flange portion 47 of the substrate holding portion 15*b* is formed with wiring openings 50 each having an elongated rectangular opening in a state of penetrating through the substrate holding portion 15*b* in the thickness direction. The wiring openings 50 are formed at positions corresponding to joint portions 60 which are at superposed positions at which substrate terminal portions 53 of the wiring substrate 30 and the other end side terminal portions 54 of the flexible cables 40 arranged so as to be positioned at predetermined positions on the substrate mounting surface 46 are superposed with each other. The dimensions of the wiring openings 50 are set to be slightly larger than those of the other end terminal portions 54 and the substrate terminal portions 53. Accordingly, when the other end portions of the flexible cables 40 and the wiring substrate 30 are arranged on the substrate mounting surface 46 in the state of being positioned by the positioning pins 51, the joint portions 60 face the interior of the wiring openings 50.

The flexible cables 40 are each configured in such a manner that a drive IC 58 configured to control application of a drive voltage to a piezoelectric element 36 is mounted on a surface of a base film such as a polyimide film, and a conductive pattern to be connected to the drive IC 58 is formed of a copper film, and the conductive pattern and the drive IC 58 are covered with resist. At one end portion of each of the flexible cables 40, a one-end side terminal portion (not illustrated) is formed to be in conductive contact with the piezoelectric element 36 and at the other end portion thereof, the other end terminal portion 54 (wiring end portion) is formed to be in conductive contact with the substrate terminal portion 53 of the wiring substrate 30. At the other end portions of the flexible cables 40 at positions corresponding to the positioning pins 51 of the substrate mounting surface 46, cable through holes 59 which allow insertion of the positioning pins 51 are formed (see FIG. 5) at two positions.

The flexible cables 40 are housed in the wiring spaces 22 in a state in which one end portion thereof is connected to an element end portion of the piezoelectric element 36. In other words, as illustrated in FIG. 2, the flexible cables 40 are drawn out from the head unit 16 into the wiring spaces 22 in a substantially vertical position with respect to a nozzle forming surface (nozzle plate 23). As described above, the wiring spaces 22 are formed between the supply flow channels 14 at both sides in the first direction in the case 15. Therefore, the flexible cables 40 are disposed between the supply flow channels 14 without being interfered with by the supply flow channels 14. In other words, since the supply flow channels 14 do not pass through the wiring spaces 22 because the supply flow channels 14 are formed on the both sides of the wiring spaces 22 in the first direction, the wiring spaces 22 can be used effectively for wiring the flexible cables 40. The flexible cables 40 drawn out into the wiring spaces 22 are each bent at a midpoint (between one end portion and the other end portion thereof) in the wiring spaces 22. Portions on the distal sides of the bent portion (the other end portion sides) take positions inclined with respect to the nozzle forming surface so as to extend along the guide surfaces 39 of the wiring spaces 22. In this manner, by wiring the flexible cables 40 by bending the same, the height of the case 15 may be reduced, which contributes to decrease in the size of the entire recording head 3. The other end portions of the flexible cables 40 are drawn out from the wiring spaces 22 along the guide surfaces 39 toward the substrate mounting surface 46, and the positioning pins 51 are respectively inserted into the respective cable through holes 59, and are arranged on the wiring areas 49 of the substrate mounting surface 46.

Figure 6:
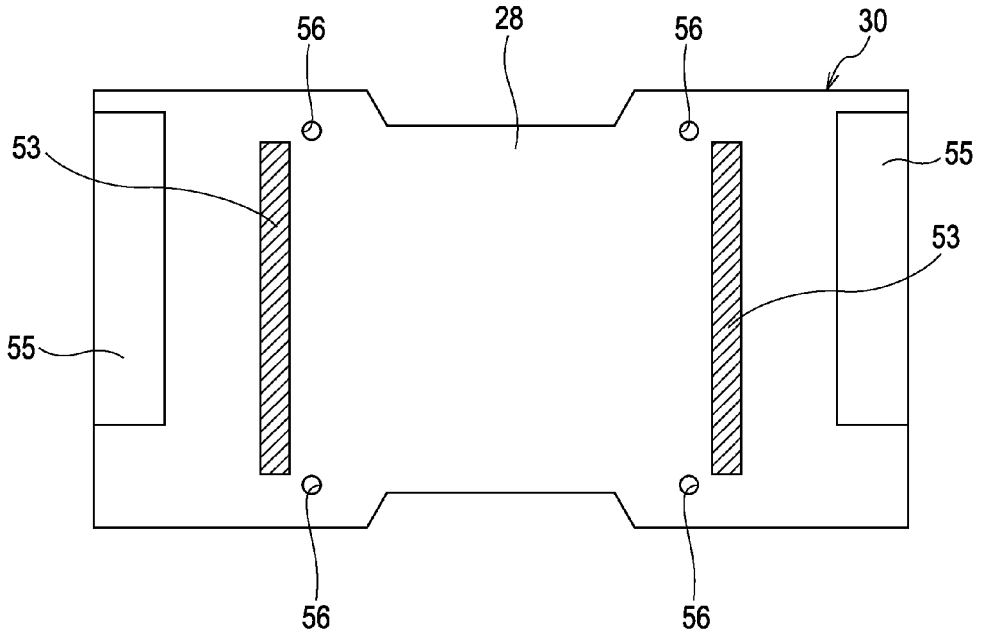
FIG. 6 illustrates a flexible cable.

FIG. 6 illustrates a plan view for explaining a configuration of the wiring substrate 30 and illustrates a surface on the substrate mounting surface 46 side of the wiring substrate 30. The wiring substrate 30 is a substrate configured to receive a drive signal from the printer body, and is formed with a wiring pattern or the like for supplying the drive signal to the piezoelectric element 36 via the flexible cables 40. The wiring substrate 30 is formed with the substrate terminal portions 53 which are in conductive contact with the other end terminal portions 54 of the flexible cables 40, and includes a connector 55 for connection to the printer body side and other electronic components mounted thereon. On the wiring substrate 30 of the embodiment, two of the substrate terminal portions 53 are formed so as to correspond to the other end terminal portions 54 of the two flexible cables 40 arranged on the substrate mounting surface 46. Wiring members such as a FFC (Flexible Flat Cable) are connected to the connector 55, and the wiring substrate 30 is configured to receive the drive signal from the printer body side via the FFC.

On the wiring substrate 30, a total of four substrate through holes 56 which allow insertion of the positioning pins 51 are formed at positions corresponding to the positioning pins 51 of the substrate mounting surface 46. The wiring substrate 30 is arranged between openings of the supply flow channels 14 formed on both sides in the first direction on the substrate mounting surface 46 in a state in which a substrate terminal portion forming surface faces the substrate mounting surface 46 of the case 15, the positioning pins 51 are inserted through the respective substrate through holes 56, and other end portions 9*b* of the flexible cables 40 are interposed therebetween. Accordingly, the positions of the substrate terminal portions 53 and the other end terminal portions 54 of the flexible cables 40 on a flat surface match. The positions of superimposition of the terminal portions correspond to the joint portions 60.

Figure 7:
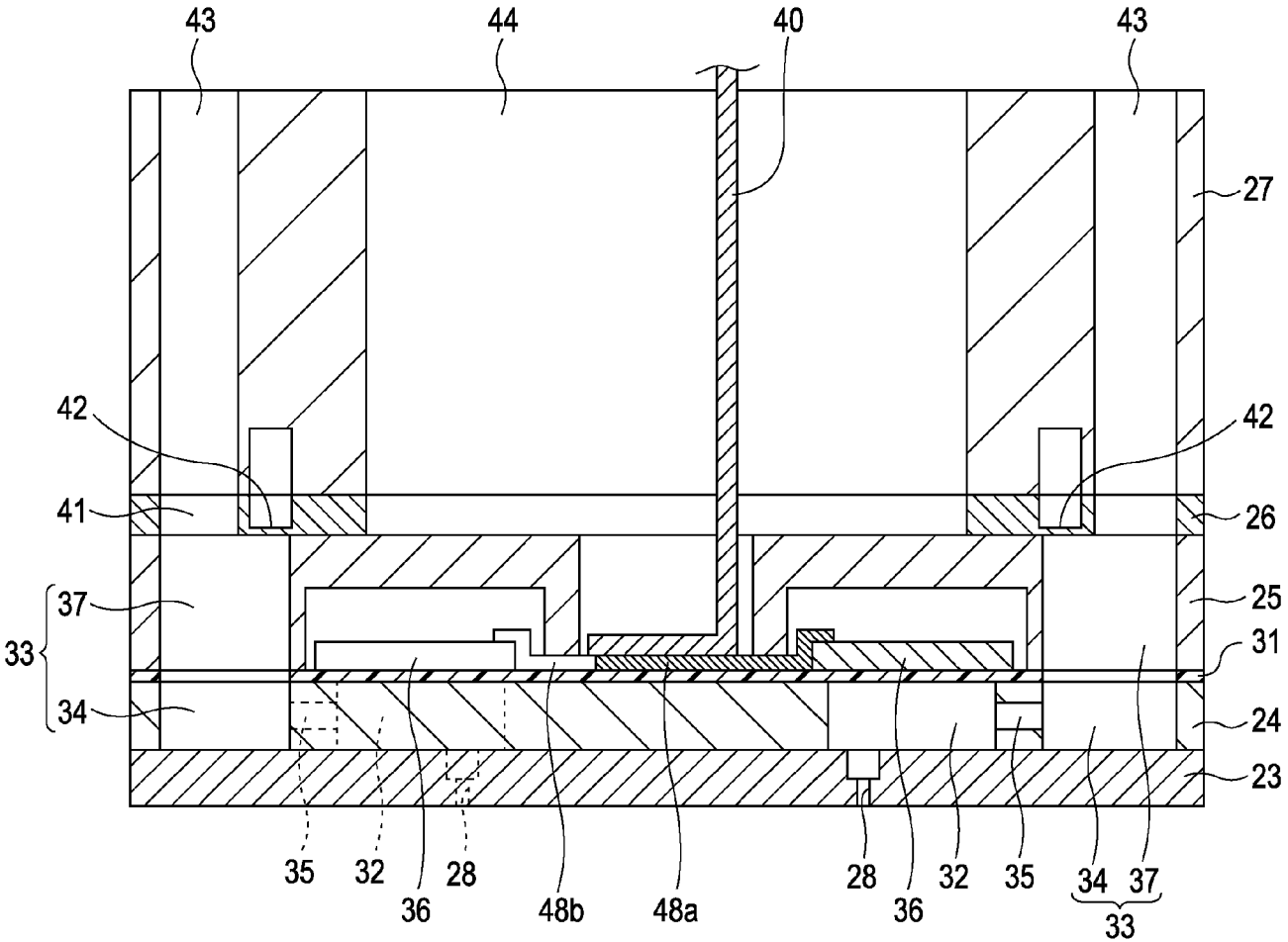
FIG. 7 is a cross-sectional view of a head unit.

FIG. 7 illustrates a cross-sectional view showing an internal configuration of the head unit 16. The head unit 16 of the embodiment basically includes the nozzle plate 23, a flow channel substrate 24, a common liquid chamber substrate 25, and a compliance substrate 26, and is fitted in a unit case 27 in a state in which these members are stacked. The nozzle plate 23 (a type of nozzle formed member) is a plate-like member having a plurality of nozzles 28 formed in rows at a pitch corresponding to a dot formation density. In this embodiment, each nozzle row is configured by forming 360 nozzles 28 at a pitch of 360 dpi.

The flow channel substrate 24 is formed of a thin resilient film 31 formed of silicon dioxide on an upper surface (the surface on the common liquid chamber substrate 25 side) by thermal oxidation. The flow channel substrate 24 is formed of a plurality of pressure chambers 32 defined by a plurality of partitioning walls by using an anisotropic etching process so as to correspond to the respective nozzles 28. Outside the row of the pressure chambers 32 in the flow channel substrate 24, communicating spaces 34 are formed which define parts of the common liquid chambers 33 as chambers to allow introduction of ink common to the respective pressure chambers 32. The communicating spaces 34 communicate with the respective pressure chambers 32 via the ink introduction channels 43.

On the resilient film 31 on the upper surface of the flow channel substrate 24, the piezoelectric elements 36 are formed by stacking a metallic lower electrode film, a piezoelectric body layer formed of lead zirconate titanate (PZT), and a metallic upper electrode film in this order for the respective pressure chambers 32. The piezoelectric elements 36 are piezoelectric elements of a so-called flexible mode, and are formed so as to cover upper portions of the pressure chambers 32. Electrode wiring portions 48*a* and 48*b* extend over the resilient film 31 respectively from respective element electrodes of the piezoelectric elements 36, and wiring terminals (not illustrated) provided at one end portions of the flexible cables 40 are electrically connected to portions corresponding to electrode terminals of the electrode wiring portions. The respective piezoelectric elements 36 are deformed when a drive voltage is applied between the upper electrode film and the lower electrode film through the flexible cables 40.

Arranged on the flow channel substrate 24 formed with the respective piezoelectric elements 36 is the common liquid chamber substrate 25 having through spaces 37 penetrating therethrough in the thickness direction. The common liquid chamber substrate 25 is manufactured by using a silicone monocrystal substrate in the same manner as the flow channel substrate 24 and the nozzle plate 23. The through spaces 37 on the common liquid chamber substrate 25 communicate with the communicating spaces 34 of the flow channel substrate 24 and define the parts of the common liquid chambers 33.

The compliance substrate 26 is arranged on an upper surface side of the common liquid chamber substrate 25. In areas of the compliance substrate 26 facing the through spaces 37 of the common liquid chamber substrate 25, ink introduction ports 41 for supplying ink from the ink introduction needle 20 side to the common liquid chambers 33 are formed so as to penetrate through the direction of the thickness. Two of the ink introduction ports 41 are provided for each of the common liquid chambers 33. A pair of the ink introduction ports 41 communicating with the same common liquid chamber 33 are formed at positions corresponding to both sides of the common liquid chambers 33 in the first direction. Areas of the compliance substrate 26 other than the ink introduction ports 41 of the areas facing the through spaces 37 are the flexible portions 42 formed to be thin, and the common liquid chambers 33 are defined and formed by sealing upper openings of the through spaces 37 by the flexible portions 42. The flexible portions 42 function as compliance portions which absorb pressure variations of the ink in the common liquid chambers 33.

The common liquid chambers 33 in the embodiment are spaces extending along the nozzle rows (first direction) for each of the nozzle rows, and ink common to the respective pressure chambers 32 belonging to the nozzle rows is introduced thereto. As described above, the common liquid chambers 33 communicate with the supply flow channels 14 of the case 15 via the ink introduction channels 43 at the both end portions in the first direction. Therefore, the ink introduced from the ink introduction channels 43 side to the common liquid chambers 33 flows toward the center portion from the both end sides in the first direction. As illustrated in FIG. 3, ceiling surfaces of the common liquid chambers 33 have a tapered shape inclining gradually downward (toward the nozzle forming surface) from the both end portions in the first direction respectively toward the center portion. In other words, the height of the flow channel in the common liquid chambers 33 is gradually reduced from the both end sides in the first direction toward the center side. Accordingly, the ink introduced into the common liquid chambers 33 flows smoothly from the both end portions to the center portion. Therefore, the pressure of ink supplied to the respective pressure chambers 32 communicating with the common liquid chambers 33 may be aligned as much as possible.

The unit case 27 is a member formed with the ink introduction channels 43 communicating with the ink introduction ports 41 for introducing ink introduced from the ink introduction needle 20 side toward the common liquid chambers 33, and each formed with a depression for allowing swelling of the flexible portion 42 in areas opposing the flexible portion 42. Two each of the ink introduction channels 43 are provided for each of the common liquid chambers 33, and formed in the state of penetrating therethrough in the height direction of the unit case 27. Upstream ends of the ink introduction channels 43 communicate with the supply flow channels 14 of the case 15, and downstream ends thereof communicate with the common liquid chambers 33 via the ink introduction ports 41. A pair of the ink introduction channels 43 communicating with the same common liquid chamber 33 are formed respectively at the positions corresponding to the both sides of the common liquid chamber 33 in the first direction. At a center portion of the unit case 27 (an area between the ink introduction channels 43 on the both sides in the first direction), a space 44 is formed so as to penetrate therethrough in the thickness direction, and one end of each of the flexible cables 40 is inserted into the space 44 and is electrically connected to an electrode wiring portion 48 of the piezoelectric elements 36.

The nozzle plate 23, the flow channel substrate 24, the common liquid chamber substrate 25, the compliance substrate 26, and the unit case 27 are joined with respect to each other by being heated in the stacked state with an adhesive agent or a thermally adhesive film interposed therebetween.

The recording head 3 provided with the head units 16 configured as described above is mounted on the carriage 4 so that the nozzle row direction (the first direction) is aligned with the secondary scanning direction in a state in which the respective nozzle plates 23 face the platen. The head units 16 each take ink from the ink cartridge 7 to the common liquid chamber 33 side from the ink introduction port 41 through the ink introduction needle 20, the flat flow channel 13, the supply flow channels 14, and the ink introduction channels 43, and ink flow channels extending from the common liquid chambers 33 to the nozzles 28 are filled with ink. Then, pressure variations are caused in ink in the corresponding pressure chambers 32 by causing the piezoelectric elements 36 to be flexibly deformed by applying the drive voltage from the flexible cables 40 to the piezoelectric elements 36, and ink is ejected from the nozzles 28 by using the pressure variations of ink.

Subsequently, a method of manufacturing the recording head 3 will be described.

The flexible cables 40 connected at one of the end portions thereof to the electrode wiring portions 48 of the piezoelectric elements 36 of the head units 16 are drawn out into the wiring spaces 22 in the substantially vertical position with respect to the nozzle forming surfaces from the head units 16, and are bent at the midpoint in the interior of the wiring spaces 22, while portions of the other ends on the distal side from the bent portion are drawn out from the wiring space 22 sides along the guide surfaces 39 to the substrate mounting surfaces 46. Then, the flexible cables 40 are arranged on the wiring areas 49 of the substrate mounting surfaces 46 in a state of being positioned by the positioning pins 51 inserted into the respective cable through holes 59, respectively. In this case, the surfaces of the other end portions of the flexible cables 40 where the other end terminal portions 54 are formed face the opposite side from the substrate mounting surface 46 (upward).

Subsequently, the wiring substrate 30 is stacked on the other end portions of the flexible cables 40 on the substrate mounting surface 46. In this case, the wiring substrate 30 is mounted on the substrate mounting surface 46 by inserting the positioning pins 51 into the substrate through holes 56 and in a state in which the surface where the substrate terminal portions 53 are formed faces the substrate mounting surface 46 side, that is, the other end portions of the flexible cables 40 on the substrate mounting surface 46 in a state in which the other end portions of the flexible cables 40 are interposed therebetween. Accordingly, the other end terminal portions 54 and the substrate terminal portions 53 are overlapped in a state in which the relative positions between the respective terminals of the other end terminal portions 54 and the respective terminals of the substrate terminal portions 53 match. In this state, the joint portions 60 where the other end terminal portions 54 and the substrate terminal portions 53 are overlapped face into the wiring openings 50 provided on the substrate holding portion 15*b*. Solder plating is applied in advance on at least one of the other end terminal portions 54 and the substrate terminal portions 53. In the embodiment, the other end terminal portions 54 and the substrate terminal portions 53 are soldered and electrically joined by heating the joint portions 60 through the wiring openings 50 using a heat tool or the like.

As described above, in the recording head 3 of the invention, since the supply flow channels 14 communicate with the common liquid chambers 33 at the end portions of the common liquid chambers 33 in the first direction, and the flexible cables 40 are disposed inside the supply flow channels 14 in the first direction in the interior of the case 15, the flexible cables 40 may be wired by being bent as needed without causing the interference with the supply flow channels 14 between the piezoelectric elements 36 and the wiring substrate 30 or without providing clearance holes or the like to allow passage of the supply flow channels 14 in the flexible cables 40. Therefore, even when the entire length of the flexible cables 40 are determined to be constant, the wiring space in the height direction of the case 15 can be reduced by wiring the flexible cables 40 in a bent state or by wiring obliquely with respect to the nozzle forming surface, which contributes to downsizing of the recording head 3.

As described above, since the clearance holes or the like which allow passage of the supply flow channels 14 does not have to be provided in the flexible cables 40, the size of the flexible cables 40 may be reduced correspondingly, which contributes to downsizing of the recording head 3. In the same manner, since the clearance holes or the like which allow passage of the supply flow channels 14 do not have to be provided on the wiring substrate 30 as well, the size of the wiring substrate 30 may be reduced correspondingly.

Also, since the recording head 3 of the embodiment has a configuration in which the substrate terminal portions 53 are provided on the nozzle forming surface side in a state in which the wiring substrate 30 is arranged on the substrate mounting surface 46 and the substrate terminal portions 53 and the other end terminal portions 54 of the flexible cables 40 are electrically connected, though holes for allowing insertion of the flexible cables 40 do not have to be provided in the wiring substrate 30, so that the size of the wiring substrate 30 may be reduced correspondingly, which contributes to further downsizing of the recording head 3.

In the recording head 3 of the embodiment, since two in total supply flow channels 14 communicate in parallel at both end portions in the first direction for each of the common liquid chambers 33, pressure loss in the supply flow channels 14 may be reduced in comparison with a configuration in which one supply flow channel 14 communicate with one common liquid chamber 33. In addition, the distance to the pressure chamber 32 located at the farthest position from the communicating portions of the common liquid chambers 33 (that is, the openings of the ink introduction channels 43 in the embodiment) with respect to the supply flow channels 14 becomes half the length of the common liquid chambers 33 in the first direction. Therefore, lowering of the pressure of ink supplied to the pressure chambers 32 may be inhibited.

The invention is not limited to the embodiments described above and various modifications may be made on the basis of description of claims.

For example, in the embodiment, an example in which two each of the supply flow channels 14 and the ink introduction channels 43 communicating therewith and so forth are provided at positions corresponding to the both sides of the common liquid chambers 33 in the first direction has been exemplified, the invention is not limited thereto. A configuration in which one each of the supply flow channel 14 and the ink introduction channel 43 communicating thereto are provided for each of the common liquid chambers 33, and the supply flow channels 14 communicate at one end portion of the common liquid chambers 33 in the first direction may be employed.

In the description given above, a so-called flexural oscillation type piezoelectric element has been exemplified as the pressure generating unit in the invention. However, the invention is not limited thereto, and the invention may be applied to a configuration in which a so-called electrostatic type actuator which displaces part of the pressure chamber by an electrostatic force, or other types of pressure generating units such as heat generating element or the like which causes pressure variations in the pressure chamber by air bubbles caused by heating.

In the description given above, the ink jet recording head 3 as a type of liquid ejecting head is exemplified, the invention may also be applied to other liquid ejecting heads employing a configuration including a holding member provided with a head unit configured to eject liquid from a nozzle, a wiring member configured to be electrically connected to a pressure generating unit, and a wiring substrate configured to supply a drive signal to the pressure generating unit through the wiring member. For example, the invention may be applied to a color material ejecting head used for manufacturing color filters such as liquid crystal display or the like, an electrode ejecting head used for forming electrode such as an organic EL (Electro Luminescence) display, an FED (surface light-emitting display), a bioorganic substance ejecting head used for manufacturing a biochip, and so forth.

What is claimed is:

1. A liquid ejecting head comprising:

a holding member, the holding member including:

a head unit including a nozzle forming surface in which nozzles are formed so as to be arranged horizontally in a first direction; a pressure generating unit configured to cause pressure variations in a pressure chamber communicating the nozzles; and a common liquid chamber formed along the first direction and to which a liquid common to a plurality of the pressure chambers is introduced, and configured to eject the liquid from the nozzles by driving the pressure generating unit;

a wiring member electrically connected at an end portion thereof to the pressure generating unit;

a wiring substrate electrically connected to the other end portion of the wiring member and configured to supply a drive signal to the pressure generating unit via the wiring member;

a supply flow channel configured to supply the liquid from a liquid supply source to the common liquid chamber, wherein the head unit is fixed to the holding member in a position in which the nozzle forming surface thereof faces a first surface side of a head fixing portion, and the wiring substrate is arranged on a second surface side of the head fixing portion opposite from the first surface, the supply flow channel communicates with the common liquid chamber at an end of the common liquid chamber in the first direction, and the wiring member is disposed inside the supply flow channel in the first direction in the holding member.

2. The liquid ejecting head according to claim 1, wherein an opening portion on an inlet port side of the supply flow channel is formed on the outside of the wiring substrate in the first direction in the second surface side.

3. A liquid ejecting apparatus comprising the liquid ejecting head according to claim 2.

4. The liquid ejecting head according to claim 1, wherein the wiring substrate includes a substrate terminal portion on the first surface side thereof in a state of being arranged on the second surface, and the substrate terminal portion and an other end side terminal portion of the wiring member are electrically connected to each other.

5. A liquid ejecting apparatus comprising the liquid ejecting head according to claim 4.

6. A liquid ejecting apparatus comprising the liquid ejecting head according to claim 1.

* * * * *